US008693697B2

(12) United States Patent
Van Dongen

(10) Patent No.: US 8,693,697 B2
(45) Date of Patent: Apr. 8, 2014

(54) MATRIX ENCODER WITH IMPROVED CHANNEL SEPARATION

(75) Inventor: Charlie Corneles Van Dongen, Frankston (AU)

(73) Assignee: Reality IP Pty Ltd, Caulfield, Victoria (AU)

( * ) Notice: Subject to any disclaimer, the term of this patent is extended or adjusted under 35 U.S.C. 154(b) by 305 days.

(21) Appl. No.: 13/328,513

(22) Filed: Dec. 16, 2011

(65) Prior Publication Data

US 2012/0308016 A1 Dec. 6, 2012

(30) Foreign Application Priority Data

Jun. 6, 2011 (AU) ..... 2011902227

(51) Int. Cl.
*H04R 5/00* (2006.01)

(52) U.S. Cl.
USPC ..... 381/23; 381/17; 381/18; 381/19; 381/20; 381/21; 381/22; 704/500; 704/503

(58) Field of Classification Search
USPC ..... 381/17, 18, 19, 20, 21, 22, 23; 704/500, 704/503
See application file for complete search history.

(56) References Cited

U.S. PATENT DOCUMENTS 7,107,211 B2 * 9/2006 Griesinger ..... 704/228

* cited by examiner

*Primary Examiner* — Xu Mei
*Assistant Examiner* — Paul Kim

(57) ABSTRACT

An encoder and encoding method for use in a surround sound system wherein at least four audio input signals representing an original sound field are encoded into two channel signals and the encoded two channel signals are decoded into at least four audio output signals corresponding to the four audio input signals. The encoder includes matrix structure connected to receive the four audio input signals for encoding the four input signals into two channel output signals. The matrix structure is responsive to the four input signals for producing L and R output signals as follows:

$$L=\mathrm{FL}+k\mathrm{FR}+j\mathrm{RL}+jk\mathrm{RR}$$

$$R=\mathrm{FR}+k\mathrm{FL}-j\mathrm{RR}-jk\mathrm{RL}$$

wherein k denotes a transformation or matrix constant having a value approximately 0.207 and j denotes a 90 degree phase shift.

3 Claims, 5 Drawing Sheets

MATRIX ENCODER WITH IMPROVED CHANNEL SEPARATION

CROSS REFERENCE TO RELATED APPLICATION

The present invention is related to the following international patent application assigned to the present applicant the disclosure of which is incorporated herein by cross reference:

PCT/AU2010/001666—IMPROVED MATRIX DECODER FOR SURROUND SOUND

FIELD OF THE INVENTION

The present invention relates to an improved matrix encoder for surround sound. The matrix encoder may be associated with a surround sound system wherein at least four audio input signals representing an original sound field are encoded into two channels and the two channels are decoded into at least four channels corresponding to the four audio input signals.

BACKGROUND OF THE INVENTION

In a multi-channel system as described above four channels of audio signals are obtained from an original sound field and are encoded by an encoder into two channels. The encoded two channels may be recorded on recording media such as CD, DVD or the like or broadcast via stereo TV or FM radio. The encoded two channels may be reproduced from the recording media or broadcast and decoded by means of a matrix decoder back into four channels approximating the four channels of audio signals obtained from the original sound field. The decoded signals may be applied to four speakers to reproduce the original sound field through suitable amplifiers.

To facilitate an understanding of the present invention the principles of a "4-2-4" matrix playback system and a conventional encoder is described below with reference to FIGS. 1 and 2 of the accompanying drawings.

In the system shown in FIG. 1, four microphones 10, 11, 12 and 13 are installed in an original sound field 14 in order to produce four channel audio signals FL (front-left), FR (front-right), RL (rear-left) and RR (rear-right) respectively. An optional centre channel may also be produced. The four channel audio signals are supplied to encoder 15 to be transformed or encoded into two signals L and R. The outputs L and R from encoder 15 are applied to a decoder 16 to be transformed or decoded into reproduced four channel signals FL', FR', RL' and RR' approximating the original four channel signals FL, FR, RL and RR. Decoder 16 may include single or multi-band processing as described below. The reproduced four channel signals may be applied through amplifiers (not shown) to four loud speakers 17, 18, 19 and 20 located in a listening space 21 to provide a multi-channel sound field that more closely approximates the original sound field 14 when compared to a prior art two channel system.

A variety of two channel systems 22 including CD, DVD, TV, FM radio, etc. may be used to capture or store outputs L and R from encoder 15 and to supply the captured or stored outputs to decoder 16. In one example outputs L and R from encoder 15 may be recorded on a storage medium such as a CD, DVD or magnetic tape and the outputs from the storage medium may be applied to decoder 16. According to another example the outputs L and R from encoder 15 or the outputs reproduced from the recording medium may be transmitted to decoder 16 via a stereo TV or an FM stereo radio broadcasting system.

Examples of a conventional encoder 15 include Q sound, Prologic or conventional stereo. Encoder 15 in FIG. 1 may be configured as shown in FIG. 2 wherein audio signals FL and FR produced by microphones 10 and 11 disposed in the front of original sound field 14, and audio signals RL and RR produced by microphones 12, 13 disposed in the rear of original sound field 14 are applied to a conventional matrix circuit 23.

Matrix circuit 23 includes a plurality of adders/multipliers and phase shifters arranged to produce L and R output signals as follows:

$$L=\mathrm{FL}+k\mathrm{FR}+j\mathrm{RL}+jk\mathrm{RR}$$

$$R=\mathrm{FR}+k\mathrm{FL}-j\mathrm{RR}-jk\mathrm{RL}$$

wherein k denotes a transformation or matrix constant generally having a value approximately 0.414 and j denotes a 90 degree phase shift. The phase shifters may provide a substantially consistent phase shift over the entire audio frequency band. The four channel signals FL', FR', RL' and RR' may be reproduced by a conventional decoder having the same fixed matrix constant k. It may be shown that when k=0.414, separations between channel FL' and adjacent channels FR' and RL' are respectively equal to −3 dB and separation between the channels FL' and RR' in a diagonal direction equals −.infin. dB. Because the separation between adjacent channels equals −3 dB it is not possible to enjoy stereo playback of four channels with a sufficiently large directional resolution.

FIG. 3 shows a block diagram of a decoder including a variable matrix 24 having control unit 25 and decoder unit 26 and employing matrix coefficients SL, SR, SF, SB the magnitudes of which may be controlled in accordance with the phase difference between two channel signals L and R.

In the decoder shown in FIG. 3, the two channel signals L and R are applied to input terminals 27 and 28 of the decoder from a two-channel media source and hence to input terminals 29 and 30 of variable matrix 24. Input terminals 27 and 28 are also coupled to input terminals 31 and 32 of variable matrix 24 via 90 degree phase shift circuit 33. Variable matrix 24 operates to decode or dematrix the two channel signals L and R to produce four channel signals at its output terminals 34, 35, 36 and 37. Control unit 25 provides steering control signals SL, SR, SF, and SB to decoder unit 26 in accordance with the phase difference between two-channel signals L and R. The magnitudes of the steering control signals SL, SR, SF, and SB from control unit 25 may vary in opposite directions in proportion to the phase difference between signals L and R. Control signal SF may be used to control the matrix coefficient related to the front channels and control signal SB may be used to control the matrix coefficient related to the rear channels. Similarly control signal SR may be used to control the matrix coefficient related to the right channels and control signal SL may be used to control the matrix coefficient related to the left channels. Where the phase difference between signals L and R is near zero, for instance, the control signal SF operates to decrease the matrix coefficient related to the front channels thus enhancing separation between the front channels. On the other hand, control signal SB operates to increase the matrix coefficient related to the rear channels to reduce separation between rear channels. Concurrently therewith signal levels of the front channels may be increased and those of the rear channels may be decreased to improve separation between the front and rear channels.

The control unit 25 may include a phase discriminator for detecting a phase difference between signals L and R or a comparator for detecting a phase relationship between signals L and R in terms of the difference in the levels of a sum signal (L+R) and a difference signal (L−R). A reason for controlling the matrix coefficient associated with the front and rear channels by detecting the phase relationship between signals L and R is that humans have a keen sensitivity to detect the direction of a large sound but sensitivity for a small sound coexisting with the large sound may be relatively poor. Consequently, where there is a large sound in the front and a small sound in the rear playback of four channels may be more efficient if separation between the front channels is enhanced and separation between the rear channels is reduced. In contrast, where a small sound exists in the front and a large sound in the rear playback of four channels may be more efficient if separation between the rear channels is enhanced and separation between the front channels is reduced.

Where a large sound is present in the front and a small sound is present in the rear, that is, where FL, FR>>RL, RR, signals L and R may have substantially the same phase. This means that the level of a sum signal (L+R) may be higher than that of a difference signal (L−R).

Conversely, where a large sound is present in the rear while a small sound is present in the front, that is, where FL, FR<<RL, RR, signals L and R have opposite phase. In such a case, the level of the sum signal (L+R) may be lower than the level of the difference signal (L−R). For this reason, it may be possible to detect phase relationship between signals L and R by either a phase discriminator or a comparator.

A variable matrix decoder is described in international patent application PCT/AU2010/001666 assigned to the present applicant. The decoder with its intelligent tri band steering systems may achieve approximately 40 db channel separation between all decoded surround outputs on dynamic music content. One disadvantage of the decoder is that stereo encoded media lacks full left/right channel separation and sounds somewhat narrowed.

In pre digital (CD) days it was commonly accepted that 20 db separation was desirable so no crosstalk could be heard. Up to 100 db separation is achievable with modern digital technology. Still the question persists as to what level of separation is acceptable to be undetectable in practical terms by human hearing under typical music conditions.

Contrary to common belief, the direction from which sound arrives is perceived by the human ear based on both arrival time and loudness, not loudness alone. This is a psychoacoustic phenomenon known as the "HAAS" or "precedence" effect and is illustrated by a curve as shown in FIG. 4. For wave fronts with arrival time differences in a range of 1-30 milliseconds, and sound pressure level differences of up to 12 db, arrival time is the dominant determinant of perceived sound direction.

This is the region underneath the curve. Hence sound is perceived as coming from the direction of a first wave front to arrive, even if the first wave front may be up to 12 db lower in sound pressure level than a later wave front. The Haas curve basically suggests that 12 db signal level difference is required to overcome time delay clues of left/right image positioning. When a separation of 12 db was tested compared to the 100 db available with modern CD technology it was found that listeners could not pick any difference.

When the encoder shown in FIG. 2 is used there is an excess of surround separation amounting to about 40 db. What is needed is a more optimum point where the encoded stereo achieves at least 12 db separation between channels, since for the reason explained above the listener may not be able to distinguish the difference even if channel separation was infinite.

Given that a transformation or matrix constant in the encoder of 0.414 represents only 6 db of stereo separation in the encoded media, it should be possible to reduce this matrix constant to give 12 db separation in the encoded signal.

The present invention may provide a matrix encoder having improved separation between respective channels including between front and rear channels and between left and right channels.

SUMMARY OF THE INVENTION

According to one aspect of the present invention there is provided an encoder for use in a surround sound system wherein at least four audio input signals (FL, FR, RL, RR) representing an original sound field are encoded into two channel signals (L, R) and said encoded two channel signals are decoded into at least four audio output signals (FL', FR', RL', RR') corresponding to said four audio input signals, said encoder including: matrix structure connected to receive said four audio input signals for encoding said four input signals into two channel (L and R) output signals, said matrix structure being responsive to said four input signals for producing L and R output signals as follows:

$$L=\mathrm{FL}+k\mathrm{FR}+j\mathrm{RL}+jk\mathrm{RR}$$

$$R=\mathrm{FR}+k\mathrm{FL}-j\mathrm{RR}-jk\mathrm{RL}$$

wherein k denotes a transformation or matrix constant having a value approximately 0.207 and j denotes a 90 degree phase shift.

According to another aspect of the present invention there is provided an encoding method for use in a surround sound system wherein at least four audio input signals (FL, FR, RL, RR) representing an original sound field are encoded into two channel signals (L, R) and said encoded two channel signals are decoded into at least four audio output signals (FL', FR', RL', RR') corresponding to said four audio input signals, said method including: processing said four audio input signals into two channel (L and R) output signals by matrix structure responsive to said four input signals for producing L and R output signals as follows:

$$L=\mathrm{FL}+k\mathrm{FR}+j\mathrm{RL}+jk\mathrm{RR}$$

$$R=\mathrm{FR}+k\mathrm{FL}-j\mathrm{RR}-jk\mathrm{RL}$$

wherein k denotes a transformation or matrix constant having a value approximately 0.207 and j denotes a 90 degree phase shift.

DETAILED DESCRIPTION

Figure 1:
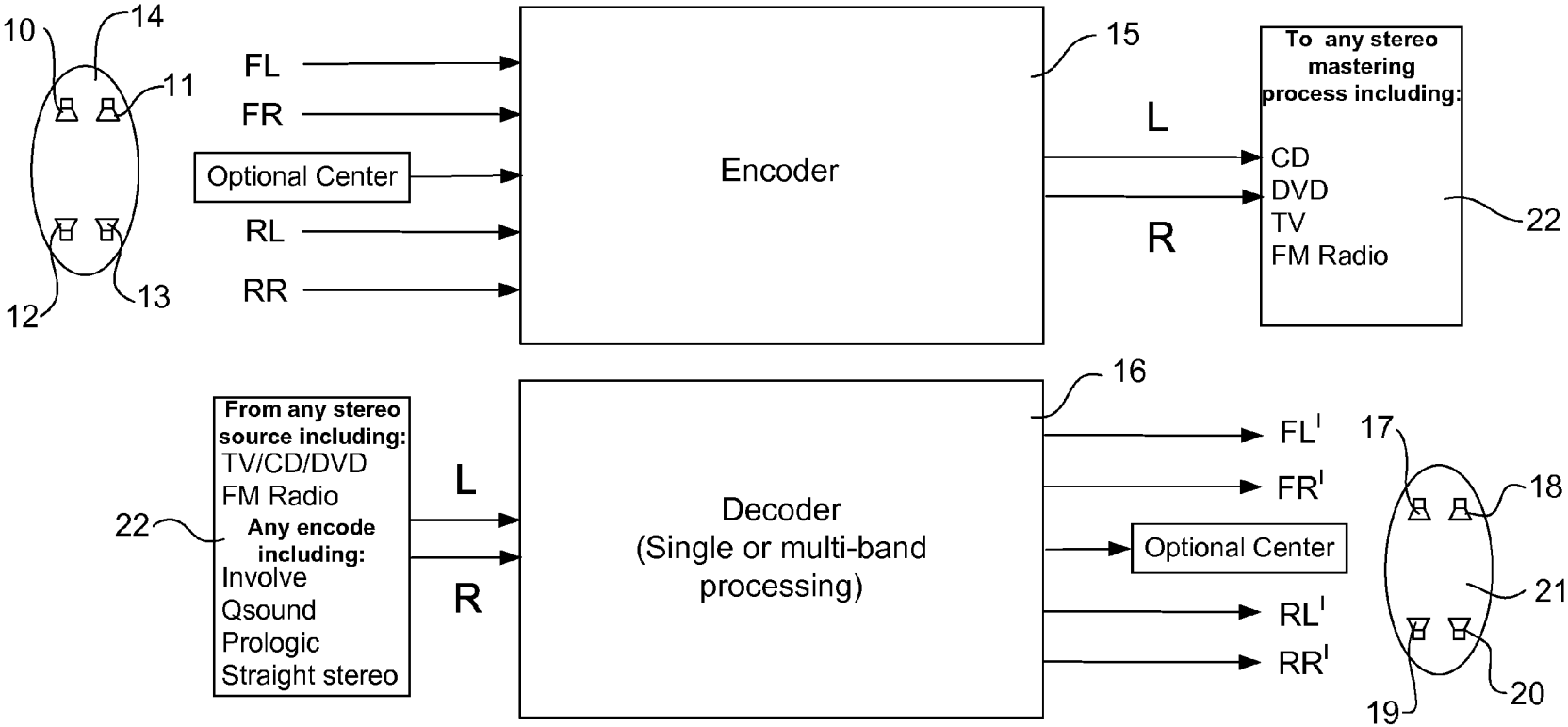
FIG. 1 is a block diagram showing principles of a "4-2-4" matrix system.
Figure 2:
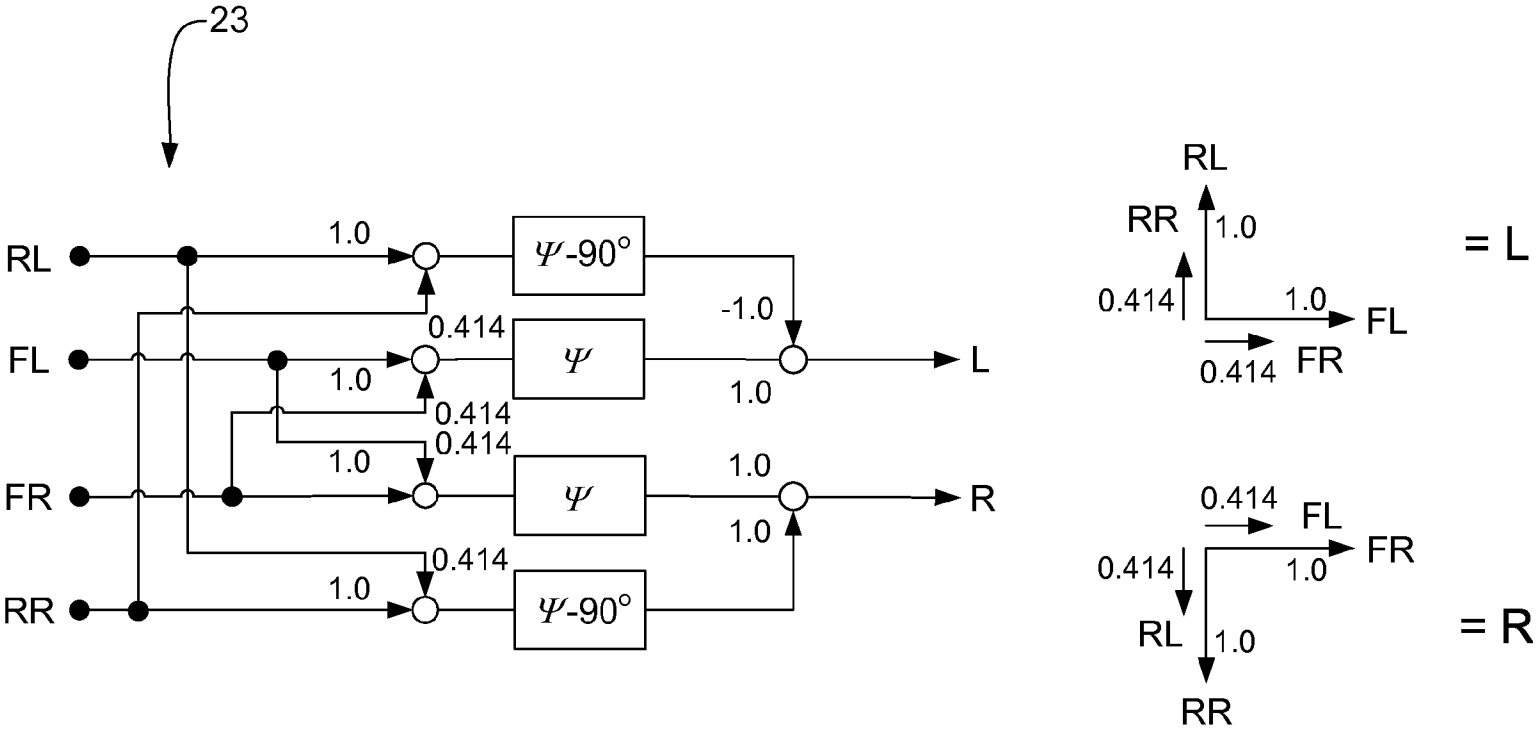
FIG. 2 shows a configuration of a conventional encoder.
Figure 3:
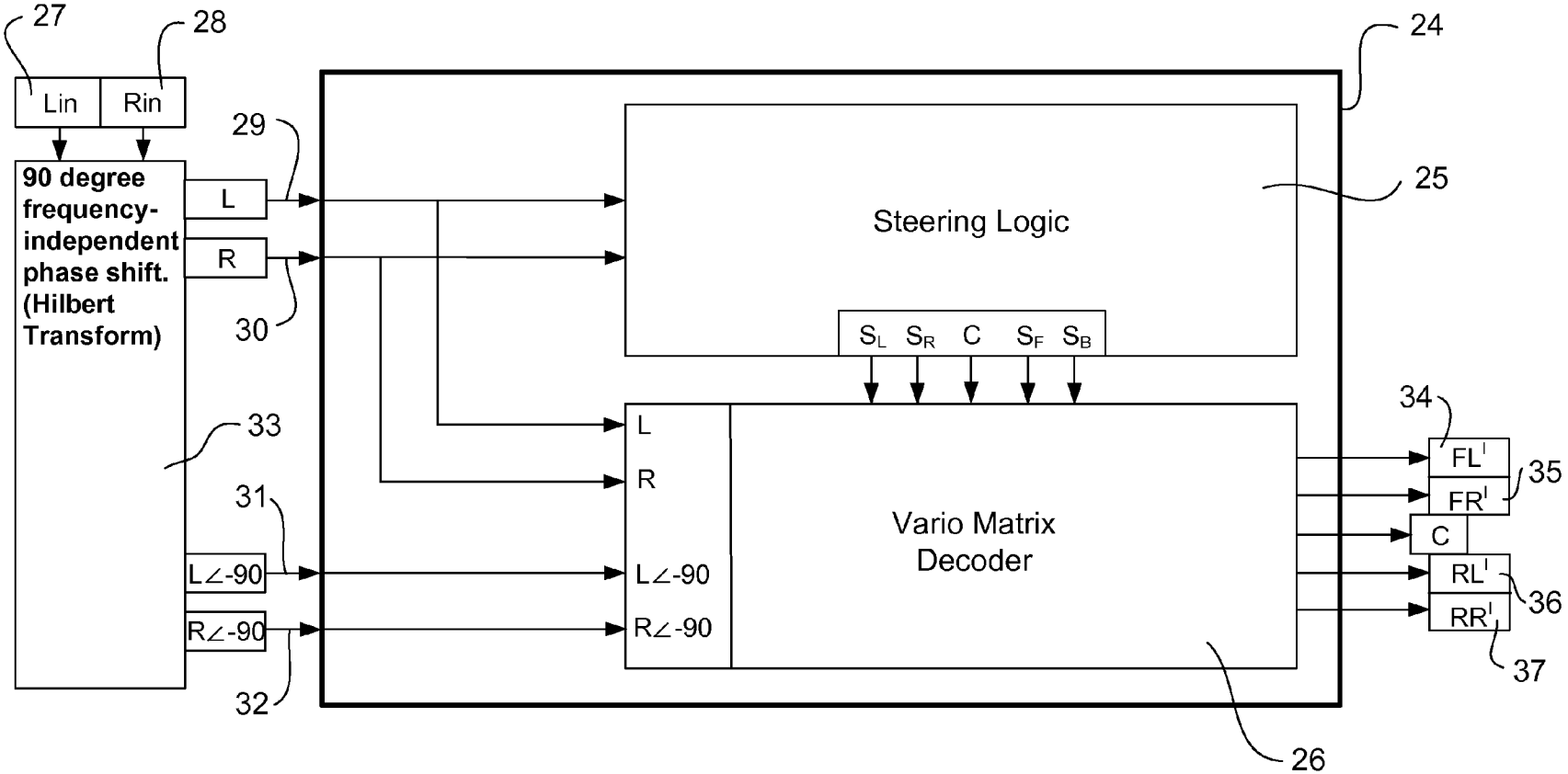
FIG. 3 shows a block diagram of a decoder including a variable matrix.
Figure 4:
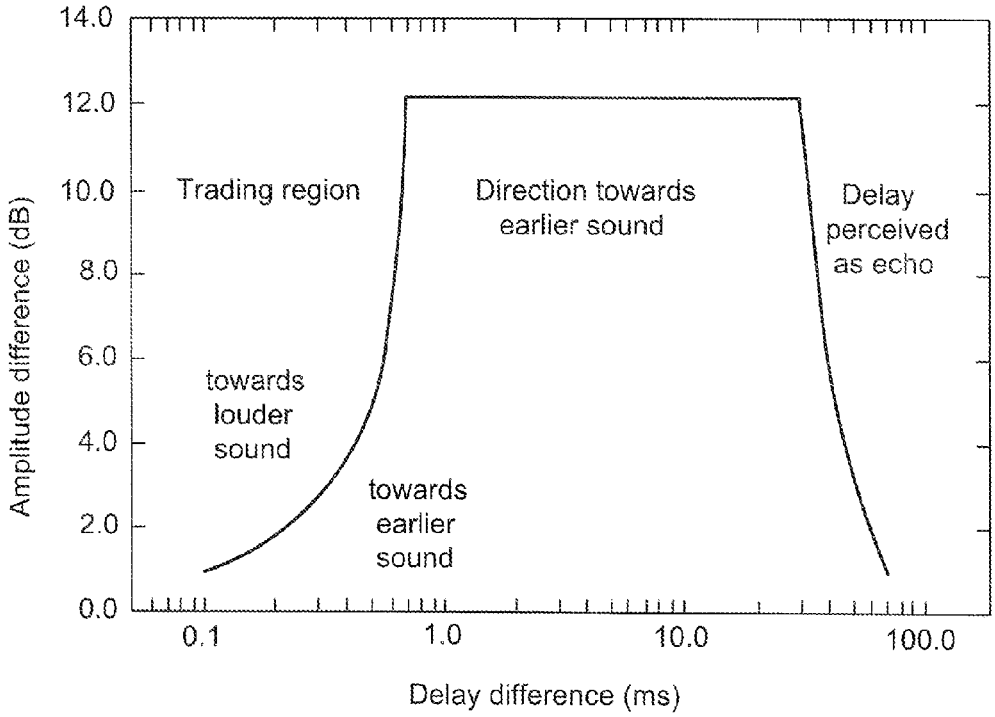
FIG. 4 shows a graph of amplitude difference (dB) versus delay difference (mS) for illustrating the HAAS or precedence effect.
Figure 5:
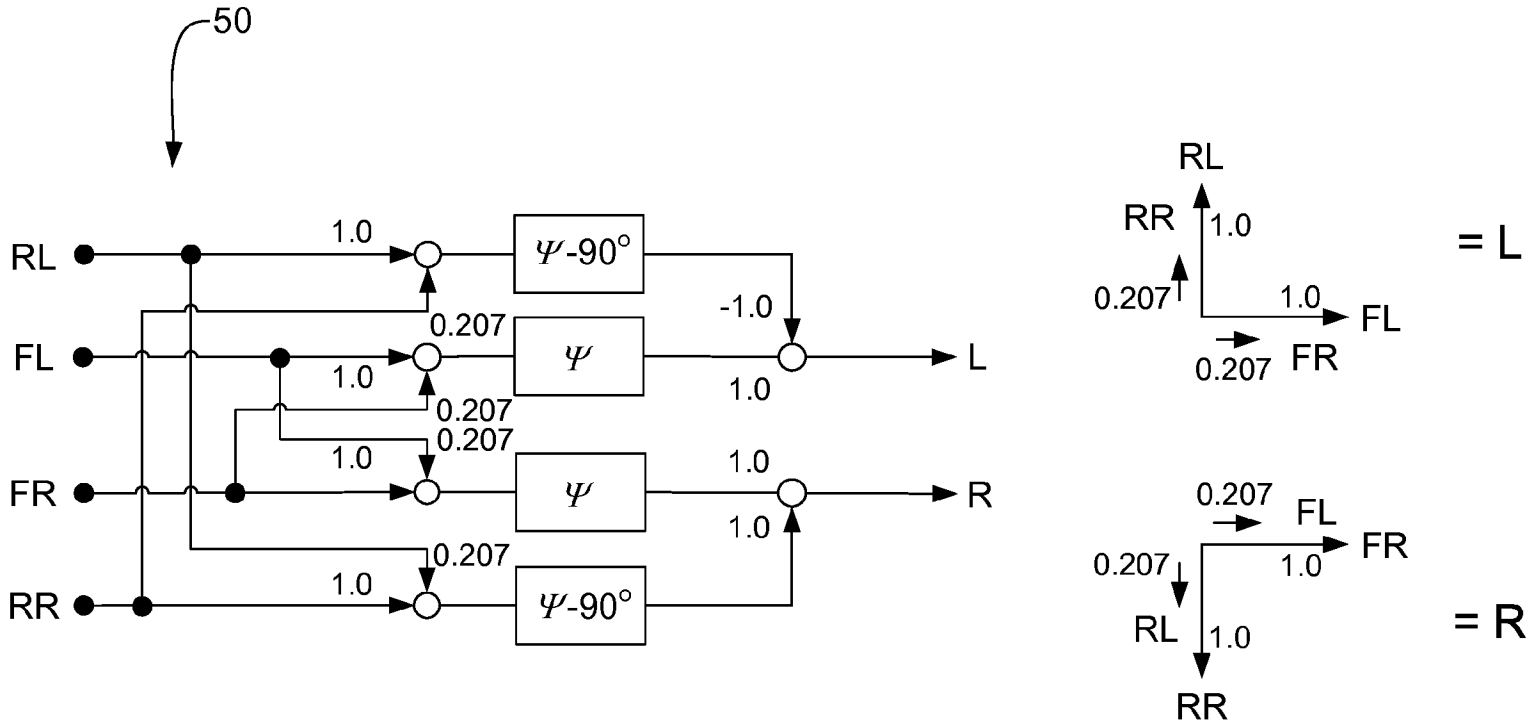
FIG. 5 shows a configuration of an encoder according to the present invention.

To achieve 12 dB separation between decoded channels a matrix circuit 50 is proposed as shown in FIG. 5. Matrix circuit 50 includes a plurality of adders/multipliers and phase shifters arranged to produce L and R output signals as follows:

$$L=\mathrm{FL}+k\mathrm{FR}+j\mathrm{RL}+jk\mathrm{RR}$$

$$R=\mathrm{FR}+k\mathrm{FL}-j\mathrm{RR}-jk\mathrm{RL}$$

wherein k denotes a transformation or matrix constant generally having a value approximately 0.207 and j denotes a 90 degree phase shift. The phase shifters may provide a substantially consistent phase shift over the entire audio frequency band. The four channel signals FL', FR', RL' and RR' may be reproduced by a conventional decoder as described in PCT application AU 2010/001666. It may be shown that when k=0.207, separation between the encoded stereo L and R output signals is equal to at least 12 db. In addition, separations between decoded channel FL' and adjacent channels FR' and RL' are respectively equal to 12 dB and separation between the channels FL' and RR' in a diagonal direction equals infinity. This makes the system more balanced with no separation bias in the encoded and decoded signals.

Testing with the full decoder described in PCT/AU2010/001666 resulted in 12 db separation in the 4 surround output signals. During the testing listeners could not hear the difference between the 12 db matrix and the 40 db matrix or discrete surround sound. In addition listeners also could not hear the difference between the encoded surround stereo and normal stereo.

Finally, it is to be understood that various alterations, modifications and/or additions may be introduced into the constructions and arrangements of parts previously described without departing from the spirit or ambit of the invention.

The invention claimed is:

1. An encoder for use in a surround sound system wherein at least four audio input signals (FL, FR, RL, RR) representing an original sound field are encoded into two channel signals (L, R) and said encoded two channel signals are decoded into at least four audio output signals (FL', FR', RL', RR') corresponding to said four audio input signals, said encoder including:

matrix structure connected to receive said four audio input signals for encoding said four input signals into two channel (L and R) output signals, said matrix structure being responsive to said four input signals for producing L and R output signals as follows:

$$L=\mathrm{FL}+k\mathrm{FR}+j\mathrm{RL}+jk\mathrm{RR}$$

$$R=\mathrm{FR}+k\mathrm{FL}-j\mathrm{RR}-jk\mathrm{RL}$$

wherein k denotes a transformation or matrix constant having a value approximately 0.207 and j denotes a 90 degree phase shift.

2. An encoder according to claim 1 wherein said matrix includes a plurality of adders/multipliers and phase shifters.

3. An encoding method for use in a surround sound system wherein at least four audio input signals (FL, FR, RL, RR) representing an original sound field are encoded into two channel signals (L, R) and said encoded two channel signals are decoded into at least four audio output signals (FL', FR', RL', RR') corresponding to said four audio input signals, said method including:

processing said four audio input signals into two channel (L and R) output signals by matrix structure responsive to said four input signals for producing L and R output signals as follows:

$$L=\mathrm{FL}+k\mathrm{FR}+j\mathrm{RL}+jk\mathrm{RR}$$

$$R=\mathrm{FR}+k\mathrm{FL}-j\mathrm{RR}-jk\mathrm{RL}$$

wherein k denotes a transformation or matrix constant having a value approximately 0.207 and j denotes a 90 degree phase shift.

* * * * *